United States Patent [19]

Nakai et al.

[11] Patent Number: 4,886,111

[45] Date of Patent: Dec. 12, 1989

[54] HEAT PIPE TYPE HEAT EXCHANGER

[75] Inventors: Satoru Nakai; Mitsuru Kamei, both of Ibaraki, Japan

[73] Assignee: Power Reactor and Nuclear Fuel Development Corporation, Tokyo, Japan

[21] Appl. No.: 225,279

[22] Filed: Jul. 28, 1988

[30] Foreign Application Priority Data

Aug. 13, 1987 [JP] Japan ..... 62-200912

[51] Int. Cl.[4] ..... F28D 15/02

[52] U.S. Cl. ..... 165/70; 165/104.14; 165/104.21

[58] Field of Search ..... 165/104.21, 104.14, 165/70

[56] References Cited

U.S. PATENT DOCUMENTS 4,090,554 5/1978 Dickinson ..... 165/70

4,560,533 12/1985 Huebotter et al. ..... 165/70

FOREIGN PATENT DOCUMENTS 606284 8/1948 United Kingdom ..... 165/70

*Primary Examiner*—Albert W. Davis, Jr.

*Attorney, Agent, or Firm*—Flynn, Thiel, Boutell & Tanis

[57] ABSTRACT

A heat pipe type heat exchanger, such as a steam generator for use in combination with a fast breeder reactor, comprises two double walls consisting of an outer wall and an inner wall and of an outer wall and an inner wall, respectively, and a plurality of double tubes each consisting of an inner tube and an outer tube coaxially receiving the inner tube therethrough. A heating fluid flows through spaces between the outer tubes and the inner walls of the double walls, while a heated fluid flows through the inner tubes. A heat transfer medium is contained in evaporating spaces each defined by the inner surface of the outer tube and the outer surface of the inner tube. The heat transfer medium is evaporated by the heat of the heating fluid, condenses over the surfaces of the inner tubes to transfer heat to the heated fluid flowing through the inner tubes. Each evaporating space is partitioned into many sections by baffle plates to enhance the heat flux in the evaporating space. The evaporating spaces are connected to manifold plenums and the manifold plenums are connected to damage detecting systems and heat transfer medium maintenance systems.

5 Claims, 4 Drawing Sheets

HEAT PIPE TYPE HEAT EXCHANGER

BACKGROUND OF THE INVENTION

1. Field of the Invention

The present invention relates to a heat exchanger for indirect heat exchange between a heating fluid and a heated fluid by a heat transfer medium which works on the principle of the heat pipe, and more specifically, to a heat pipe type heat exchanger for indirect heat exchange between a heating fluid and a heated fluid, employing double tubes each consisting of an outer tube and an inner tube coaxial with the outer tube, and capable of making a heating fluid flowing outside the double tube and a heated fluid flowing through the inner tube exchange heat through a heat transfer medium sealed in the annular space between the outer tube and the inner tube.

2. Description of the Prior Art

The fast breeder reactor uses liquid sodium as a coolant. The cooling system of the fast breeder reactor consists of a primary cooling system and a secondary cooling system, through which liquid sodium, i.e., a heat transfer medium, is circulated to transfer heat from the primary cooling system to the secondary cooling system. The liquid sodium heated in the primary cooling system by the heat generated by the reactor is transferred to the liquid sodium circulating through the secondary cooling system, and then the liquid sodium of the secondary cooling system exchanges heat with water in a steam generator 1 as shown in FIG. 3. In FIG. 3, indicated at 2 is a tube of the secondary cooling system, and at 3 is a water tube in which water is heated by the liquid sodium to generate steam.

As shown in FIG. 4, the conventional steam generator 1 included in the secondary cooling system generates steam by directly exchanging heat between water flowing through water tubes 3 and liquid sodium 11 flowing outside the water tubes 3 through the walls of the water tubes 3. Accordingly, when a serious accident occurs in case the wall of the water tube 3 is broken due to some cause, it induces the reaction of the chemically active liquid sodium with water, which produces high-temperature and high-pressure.

To obviate such an accident, a heat pipe type steam generator has been proposed. This known heat pipe type steam generator exchanges heat indirectly between liquid sodium and water through a heat transfer medium which functions on the principle of the heat pipe.

FIGS. 5(*a*) and 5(*b*) illustrate an exemplary heat pipe type steam generator 1 employing heat pipes. Each heat pipe comprises an outer tube 5 and inner tubes 4 extended within the outer tube 5. The heat pipe is immersed in liquid sodium, i.e., heating fluid. Water, i.e., a heated fluid, flows through the inner tubes 4. A heat transfer medium, such as mercury, is sealed in an evaporating space 6 formed within the outer tube 5. The heat transfer medium is evaporated by the heat of the liquid sodium, and transfers heat to the inner tubes 4 as the vapor of the heat transfer medium condenses over the surfaces of the inner tubes 4 to generate steam by heating the water flowing through the inner tubes 4. The evaporating space 6 is partitioned by baffle plates 7 each having openings therethrough into individual sections to enable efficient heat exchange in every region of the evaporating space 6.

This known heat pipe type steam generator, however, has the following problems. Since the heat exchanging capacity of a single heat pipe is limited, the actual heat pipe type heat steam generator needs to be provided with thousands or tens of thousands of such heat pipes. Since the liquid sodium or water leaks into the evaporating space 6 through cracks in the junctions of the inner tube 4 and the outer tube 5 or the heat transfer medium of the heat pipe degrades due to reaction with the materials forming the inner tubes 4 and the outer tube 5, a heat transfer medium maintenance must be provided. It is necessary to inspect the inner tubes 4 and the outer tube 5 to find damages in the inner tubes 4 and the outer tubes 5 by detecting sodium vapor or steam contained in the heat transfer medium. However, since the conventional heat pipe type steam generator 1 is provided with thousands or tens of thousands of individual heat pipes, the heat transfer medium maintenance system and a tube breakage detecting system must be provided for each one of the thousands or tens of thousands of heat pipes, which increases the cost and failure rate of the heat pipe type steam generator.

SUMMARY OF THE INVENTION

Accordingly, it is an object of the present invention to provide a heat pipe type heat exchanger which enables the maintenance of the heat transfer medium and the detection of damages in the walls thereof at a low cost.

To achieve the object of the invention, the present invention provides a heat pipe type heat exchanger comprising double walls, double tubes spaced apart from the double walls, the double walls and the double tubes separating a heating fluid and a heated fluid from each other and forming evaporating spaces for sealing a heat transfer medium therein between the double walls and between the double tubes, and manifold plenums each connected to two or more evaporating spaces and disposed between the double walls.

The above and other objects, features and advantages of the present invention will become more apparent from the following description taken in conjunction with the accompanying drawings.

BRIEF DESCRIPTION OF THE DRAWINGS

FIG. 1(*b*) is a sectional view taken on line A—A in FIG. 1(*a*);

FIG. 5(*b*) is a sectional view taken on line B—B in FIG. 5(*a*).

DETAILED DESCRIPTION OF THE PREFERRED EMBODIMENT

The present invention will be described hereinafter as applied to a steam generator 1 for generating steam through indirect heat exchange between water and liquid sodium, included in the secondary cooling system of a fast breeder reactor.

Figure 1A:
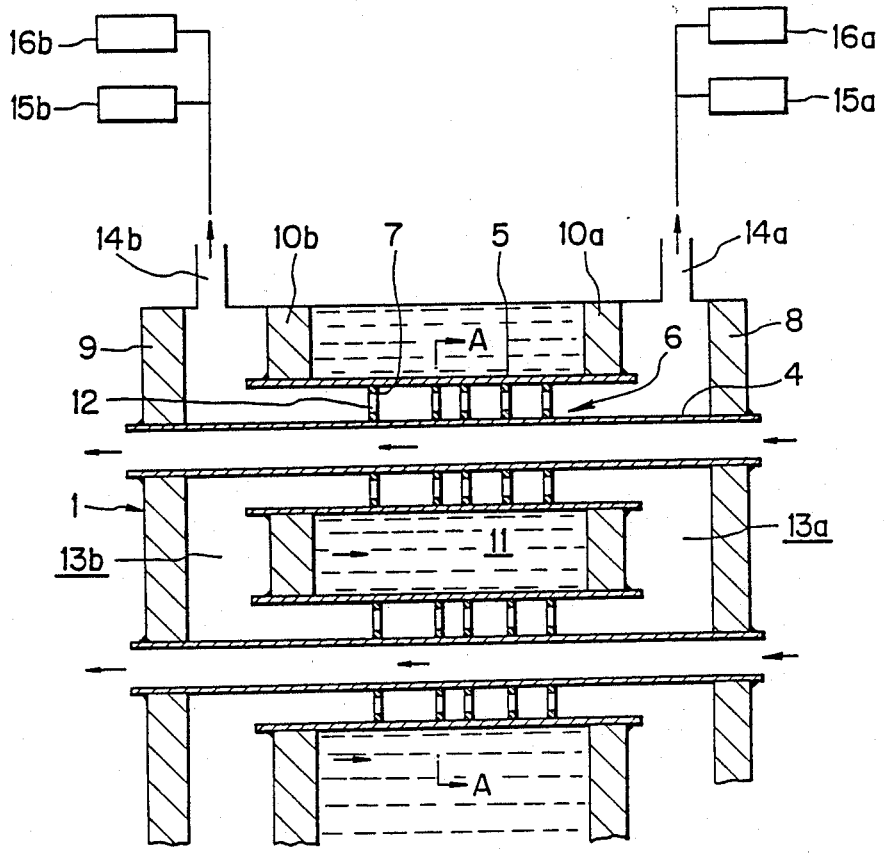
FIG. 1(*a*) is a longitudinal sectional view of a heat pipe type heat exchanger embodying a first embodiment of the present invention.
Figure 1B:
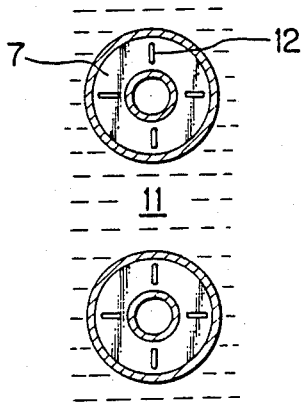

First Embodiment (FIGS. 1(*a*), 1(*b*))

Referring to FIGS. 1(*a*) and 1(*b*), the steam generator 1 has a plurality of double tubes each consisting of an outer tube 5 and an inner tube 4 coaxially extended through the outer tube 5. Water, i.e., a heated fluid, flows through the inner tubes 4. An evaporating space 6 defined by the outer surface of the inner tube 4 and the inner surface of the outer tube 5 is partitioned by multi baffle plates 7 arranged longitudinally at intervals. The inner tube 4 is longer than the outer tube 5. Each inner tube 4 has one end fixed to a water tube plate 8, and the other end fixed to a steam tube plate 9. Each outer tube 5 is fixed at the opposite ends thereof to sodium tube plates 10*a* and 10*b* disposed respectively inside the water tube plate 8 and the steam tube plate 9.

The inner tubes 4 are heating tubes. Water supplied from a feed water chamber outside the water tube plate 8 into the inner tubes 4 is heated and steam thus generated flows into a steam chamber outside the steam tube plate 9. Liquid sodium is contained in or flows through a sodium space 11 formed between the sodium tube plates 10*a* and 10*b*. That is, high-temperature liquid sodium, i.e., a heating fluid, and water are separated by the double tube consisting of the inner tube 4 and the outer tube 5 so that the liquid sodium flows outside the outer tube 5 and water, i.e., a heated fluid, flows through the inner tube 4.

A heat transfer medium, such as mercury, is sealed in the evaporating space 6 to transfer heat from the liquid sodium to the water flowing through the inner tubes 4 on the principle of the heat pipe.

The baffle plates 7 have a function of enhancing heat transfer as well as a function of holding the inner tube 4 spaced apart from the outer tube 5. The baffle plates 7 partition each evaporating space 6 into many sections, and the heat transfer medium is contained in many sections of each evaporating space 6 to prevent part of the outer surface of the inner tube 4 from drying out due to insufficient condensation of the heat transfer medium and to enhance heat transfer. Each baffle plate 7 is provided with openings 12, which enables the heat transfer medium to flow in a controlled manner between adjacent sections of the evaporating space 6, and hence the heat transfer medium can be changed and damage in the inner tube 4 and the outer tube 5 can be detected through the detection of sodium or water leaking into the evaporating spaces 6.

The plurality of evaporating spaces 6 are formed to define a necessary heat exchanging capacity. The opposite ends of each evaporating space 6 are opened respectively into manifold plenums 13*a* and 13*b* formed respectively between the water tube plate 8 and the sodium tube plate 10*a* and between the steam tube plate 9 and the sodium tube plate 10*b*. The manifold plenums 13*a*, 13*b* are connected by pipes 14*a*, 14*b* to damage detecting systems 15*a*, 15*b* and heat transfer medium maintenance systems 16*a*, 16*b*. The manifold plenums 13*a* and 13*b* are provided for collecting the heating fluid or steam leaking into the evaporating spaces 6.

The operation of the steam generator 1 constructed according to the present invention will be described hereinafter.

Water flows from the side of the water tube plate 8 through the inner tubes 4, while high temperature liquid sodium flows through the sodium space 11. The heat transfer medium contained in the evaporating spaces 6 is evaporated by the heat of the liquid sodium, and the vapor of the heat transfer medium condenses over the outer surfaces of the inner tubes 4 and transfers the heat to the water flowing through the inner tubes 4 to generate steam. The condensate on tubes 4 then falls downwardly to the inner bottom of the outer tubes 5 so as to restart the evaporation cycle. The steam thus generated flows out of the inner tubes 4 on the side of the steam tube plate 9. Then, the steam is used for energy generation such as power generation by the Rankine cycle.

If, by any chance, the inner tube 4 or the outer tube 5 is damaged due to some cause, such as corrosion, abrasion or stress, sodium or steam leaking into the evaporating space 6 flows through the openings 12 of the buffle plates 7, the manifold plenums 13*a*, 13*b* and the pipes 14*a*, 14*b* into the damage detecting systems 15*a*, 15*b*. The damage detecting systems 15*a*, 15*b* decide that the inner tube 4 or the outer tube 5 is damaged upon the detection of water or sodium in the heat transfer medium.

The heat transfer medium contained in the evaporation spaces 6 is degraded by water or sodium leaking through cracks in the junctions of the inner tubes 4 or the outer tubes 5 and by the reaction between the heat transfer medium and the material forming the inner tubes 4 and the outer tubes 5. Accordingly, the heat transfer medium maintenance systems 16*a*, 16*b* connected through the pipes 14*a*, 14*b* and the manifold plenums 13*a*, 13*b* to the evaporating spaces 6 detect the condition of the heat transfer medium, and when degraded, the heat transfer medium can be replaced.

Since the damage detecting systems 15*a*, 15*b* and the heat transfer medium maintenance systems 16*a*, 16*b* are connected through the manifold plenums 13*a*, 13*b* connected to the plurality of evaporating spaces 6, the steam generator can be manufactured at a low cost, the failure rate of the steam generator including the damage detecting systems 15*a*, 15*b* and the heat transfer medium maintenance systems 16*a*, 16*b* are reduced, and the steam generator has a high reliability.

Figure 2:
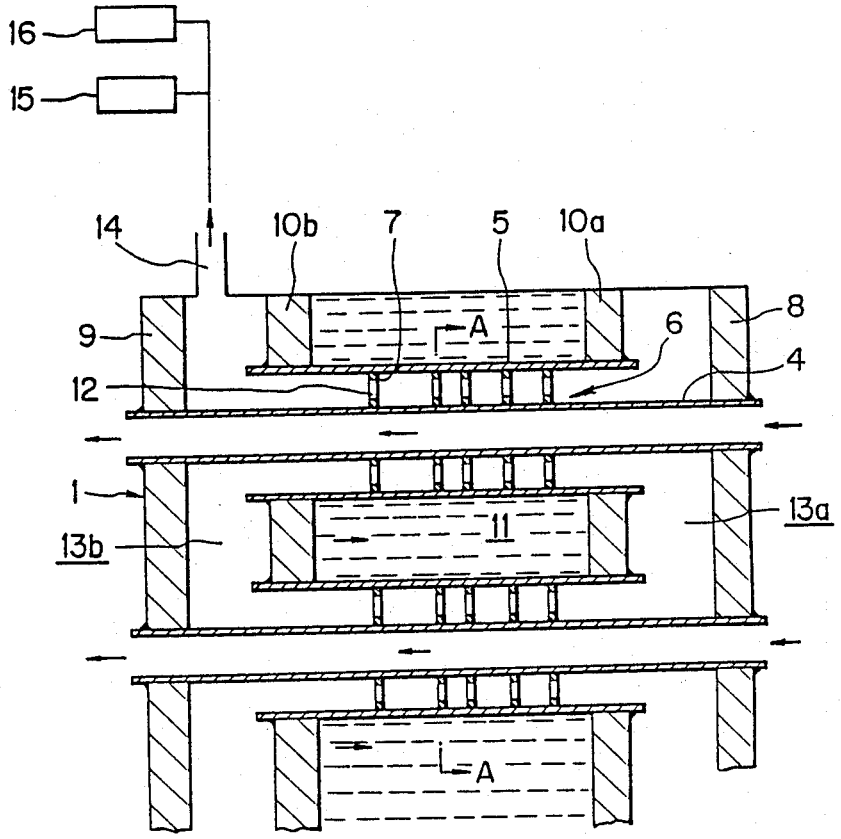
FIG. 2 is a longitudinal sectional view of a heat pipe type heat exchanger embodying a second embodiment of the present invention.
Figure 3:
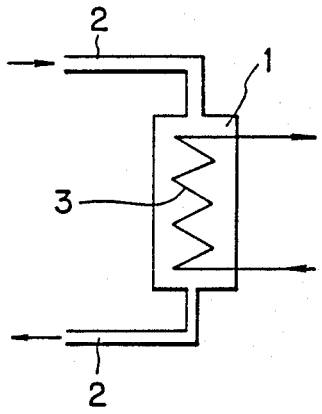
FIG. 3 (PRIOR ART)
FIG. 3 is a schematic illustration of a portion of a conventional cooling system of a fast breeder reactor.
Figure 4:
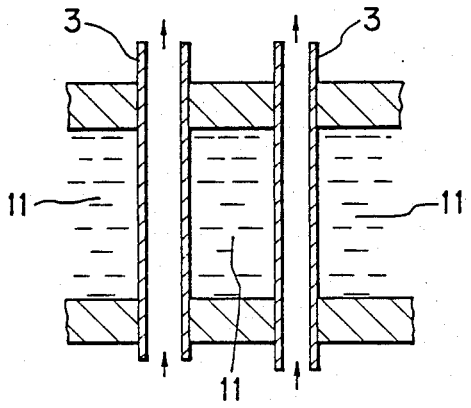
FIG. 4 (PRIOR ART)
FIG. 4 is a fragmentary schematic sectional view showing an essential portion of a conventional heat exchanger.
Figure 5A:
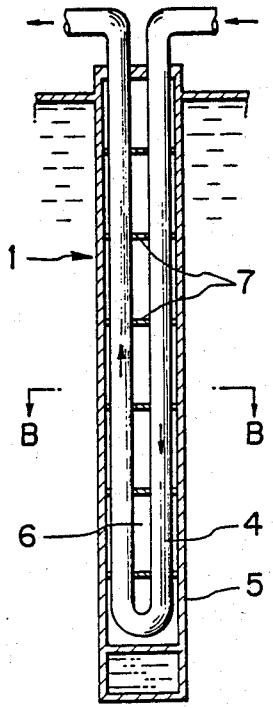
FIG. 5(a) (PRIOR ART)
FIG. 5(*a*) is a longitudinal sectional view of a conventional heat pipe type heat exchanger.
Figure 5B:
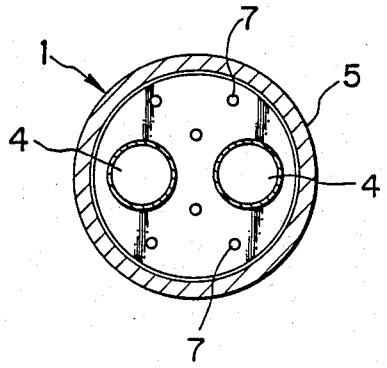
FIG. 5(b) (PRIOR ART)

Second Embodiment (FIG. 2)

The present invention is not limited to the foregoing embodiment in practical application. For example, as shown in FIG. 2, only the manifold plenum 13*b* is connected to the damage detecting system 15 and the heat transfer maintenance system 16 through the pipe 14.

Further, one of the first and second manifold plenums 13*a*, 13*b* may be omitted. In this case, one of the pipes 14*a*, 14*b*, one of the damage detecting systems 15*a*, 15*b* and one of the heat transfer medium maintenance systems 16*a*, 16*b* may be respectively omitted.

Modified Embodiment

Furthermore, all the evaporation spaces 6 need not necessarily be connected to the manifold plenums, but at least two evaporation spaces 6 may be connected to the manifold plenums.

Still furthermore, although the present invention has been described as applied to a horizontal steam generator, the present invention is applicable also to a vertical steam generator and other heat exchangers.

Moreover, sodium and water need not necessarily be separated from each other by the double tubes each consisting of the inner tube and the outer tube, but other suitable means may be employed.

As apparent from the foregoing description, the heat pipe type heat exchanger of the present invention has manifold plenums connected to at least two evaporation spaces, and a damage detecting system and a heat transfer medium maintenance system are connected to at least one manifold plenum. Accordingly, the heat pipe type heat exchanger of the present invention can be manufactured at a low manufacturing cost as compared with the conventional heat pipe type heat exchanger having a damage detecting system and a heat transfer medium maintenance system for each of a plurality of evaporation spaces. Since the failure rate of the damage detecting system and the heat transfer medium maintenance system is reduced, the heat pipe type heat exchanger of the present invention has a high reliability.

Although the invention has been described in its preferred form with a certain degree of particularity, it is to be understood that many variations and changes are possible in the invention without departing from the scope thereof.

What is claimed is:

1. A heat pipe type heat exchanger for a reactor, comprising:

(a) two outer tube plates extending generally vertically and disposed in parallel to each other and horizontally spaced apart from each other;

(b) a first fluid chamber for containing a heated fluid before heating, provided outside one of the outer tube plates;

(c) a second fluid chamber for containing the heated fluid after heating, provided outside the other outer tube plate;

(d) a plurality of inner tubes extending horizontally between and penetrating through the two outer tube plates, and each having one end sealingly fixed to one of the outer tube plates and opening into the first fluid chamber and the other end sealingly fixed to the other tube plate and opening into the second fluid chamber, the plurality of inner tubes provided for flowing the heated fluid from the first fluid chamber to the second fluid chamber;

(e) two inner tube plates disposed respectively inside of and in parallel to the outer tube plates and spaced apart from each other and from the outer tube plates, said inner tube plates defining therebetween a third fluid chamber containing a heating fluid;

(f) a first manifold plenum formed between one of the outer tube plates and an adjacent one of the inner tube plates;

(g) second manifold plenum formed between the other outer tube plate and the other inner tube plate;

(h) a plurality of outer tubes extending horizontally between and penetrating the two inner tube plates, each having one end sealingly fixed to one of the inner tube plates and opening into the first manifold plenum and the other end sealingly fixed to the other inner tube plate and opening into the second manifold plenum, and each said outer tube coaxially receiving one of the inner tubes therethrough in radially inwardly spaced relation therefrom;

(i) annular evaporation spaces each defined by an inner surface of the outer tube and an outer surface of the inner tube for evaporating a heat transfer medium which is condensed over the outer surfaces of the inner tubes;

(j) annular baffle plates coaxially and fixedly arranged within each said evaporation space so as to axially partition the evaporation space into many sections and so as to hold the inner tube and the corresponding outer tube spaced radially a substantial distance apart from from each other, the baffle plates having openings extending axially therethrough for providing restricted communication between axially adjacent sections;

(k) damage detecting means connected through a pipe and one of the manifold plenums to the evaporation spaces for detecting the condition of the heat transfer medium and for detecting if heating fluid or heated fluid has leaked into the evaporation spaces; and (l) heat transfer medium maintenance means connected through a pipe and one of the manifold plenums to the evaporation spaces for changing the heat transfer medium.

2. A heat pipe type heat exchanger according to claim 1, wherein the heating fluid is liquid sodium.

3. A heat pipe type heat exchanger according to claim 1, wherein the heat transfer medium is mercury.

4. A heat pipe type heat exchanger according to claim 1, wherein the openings in said baffle plates are spaced radially inwardly from the inner surface of the outer tube to normally prevent condensed heat transfer medium from flowing between axially adjacent sections.

5. A heat pipe type heat exchanger according to claim 4, wherein the openings in said baffle plates are also spaced radially outwardly from the outer surface of the inner tube.

* * * * *

UNITED STATES PATENT AND TRADEMARK OFFICE

CERTIFICATE OF CORRECTION

PATENT NO. : 4 886 111

DATED : December 12, 1989

INVENTOR(S) : Satoru NAKAI et al

It is certified that error appears in the above-identified patent and that said Letters Patent is hereby corrected as shown below:

Column 6, line 23; change "apart from from each" to ---apart from each---.

Signed and Sealed this

Eighth Day of January, 1991

*Attest:*

*Attesting Officer*

HARRY F. MANBECK, JR.

*Commissioner of Patents and Trademarks*